US006662619B1

(12) United States Patent
Ikeda

(10) Patent No.: US 6,662,619 B1
(45) Date of Patent: Dec. 16, 2003

(54) MOLD CLAMPING DEVICE FOR PRESSING MACHINE

(75) Inventor: Toshio Ikeda, Takaoka (JP)

(73) Assignee: Kyowa Machine Co., Ltd., Takaoka (JP)

( * ) Notice: Subject to any disclaimer, the term of this patent is extended or adjusted under 35 U.S.C. 154(b) by 0 days.

(21) Appl. No.: 09/958,744

(22) PCT Filed: Apr. 3, 2000

(86) PCT No.: PCT/JP00/02161

§ 371 (c)(1),
(2), (4) Date: Oct. 12, 2001

(87) PCT Pub. No.: WO00/62952

PCT Pub. Date: Oct. 26, 2000

(30) Foreign Application Priority Data

Apr. 16, 1999 (JP) ..... 11-147052

(51) Int. Cl.[7] ..... B21D 5/04

(52) U.S. Cl. ..... 72/433; 72/431; 72/460; 72/319; 72/556

(58) Field of Search ..... 72/431, 433, 434, 72/390.3, 390.5, 460, 459, 319

(56) References Cited

U.S. PATENT DOCUMENTS 367,012 A * 7/1887 Scarff ..... 100/268
4,944,176 A * 7/1990 Glorieux et al. ..... 72/319
5,676,357 A * 10/1997 Horn ..... 269/32

FOREIGN PATENT DOCUMENTS

| | | | | |
|---|---|---|---|---|
| DE | OF 0189887 | * | 5/1957 | |
| JP | A 50-27755 | | 3/1975 | |
| JP | A 4-13499 | | 1/1992 | |
| JP | A 9-10849 | | 1/1997 | |
| JP | 09010849 A | * | 1/1997 | ..... B21D/5/04 |

* cited by examiner

*Primary Examiner*—Allen Ostrager
*Assistant Examiner*—John S Goetz
(74) *Attorney, Agent, or Firm*—Oliff & Berridge, PLC

(57) ABSTRACT

A mold clamping device for a pressing machine which bends a plate material inserted between upper and lower molds. The mold clamping device comprises a main frame (1) of integral structure, a holding ram (13) mounted on the upper half of the mainframe (1) and for supporting the upper mold (8) for vertical movement, a pair of arch-type thick springs (6) vertically mounted on the upper half of the main frame, and a crank mechanism (10) with which the upper end of each of the arch-type thick spring is connected through a crank pin (17). The crank mechanism creates a rotational force at a position near the dead center of the crank pins (17). This rotational force resiliently deforms the arch-type thick springs (6) which in turn create a resilient force for pressing the upper mold (8) against the lower mold (9). This provides an accurate and stable clamping force between the upper and lower molds.

7 Claims, 5 Drawing Sheets

PRIOR ART

MOLD CLAMPING DEVICE FOR PRESSING MACHINE

TECHNICAL FIELD

The present invention relates to a mold clamping device for a pressing machine in which a plate material is subjected to bending or other working between upper and lower mold sections clamped against each other.

BACKGROUND ART

Various forms of pressing machines for bending plate materials are known. Where a plate material is to be bent by a blade for upper and lower molds being clamped against each other, the blade tends to exert a large force to the plate material, leading to a deviation therein. If the upper mold is pressed against the lower mold by a linearly straight force from a hydraulic cylinder or from a simple conversion of the rotation of a motor, a very large power is required. The main body of the pressing machine supporting these power sources will be subjected to overload.

The inventors have found the technical problems inherent in the proposed mold clamping device, improved it to overcome the problems and came up with the present invention.

First of all, the technical problems raised by our previously proposed mold clamping device will be described in connection with FIG. 5.

The mold clamping device shown in FIG. 5 has a main frame 50 which comprises a lower frame portion 51 having a lower mold 53 and an upper frame portion 52 having an upper mold 54. The lower and upper frame portions 51, 52 are pivotally connected to each other at the rearward ends through a pivot shaft 55. The lower and upper frame portions 51, 52 are also connected to each other at their forward ends through an arch-type thick spring 56. Thus, the structure thereof necessarily becomes complicated. And yet, the arch-type thick spring 56 causes the whole height of the mold clamping device to increase since the arch-type thick spring 56 must be curved rearwardly to an increased extent such that it will not interfere the plate bending action in the pressing machine. In addition, the arch-type thick spring 56 is a bulky metal working matter, for example, having a thickness of 15 cm and a width of 20 cm in cross-section since it must provide a strong and instantaneous force. This not only increases the manufacturing cost, but also requires a huge driving energy for moving the upper frame portion together with the arch-type thick spring. This additionally raises a poor response in power transmission.

A crank mechanism 58 for driving the arch-type thick spring 56 is provided on the upper frame portion at the top thereof. The upper end of the arch-type thick spring 56 is connected with a crank pin 60 in the crank mechanism 58 while the bottom end thereof is supported by another pin 61.

In such an arrangement, the crank mechanism will provide an opening force for elongating the arch-type thick spring. A closing spring force for depressing a holding ram 62 is created from a reactive force associated with the resilient opening deformation of the arch-type thick spring. However, the arch-type thick spring 56 highly restricts the amount of resilient deformation. It is thus difficult that the clamping force is regulated into the desired level.

For such a reason, the length of the arch-type thick spring needs to be increased. As a result, its point of action 60 will positioned upward from the upper frame portion, so that a forward thrusting force P will act on the holding ram 62 in association with the structure of opening/closing frame 1. This may destabilize the engagement between the upper and lower molds.

Even in the regulation of clamping force, the mold clamping device hardly accommodates the change in the set height of the holding ram, for example, due to mold exchange or corrective grinding since the amount of resilient opening deformation in the arch-type thick spring is smaller, that is, the range of track using the clamping force in the crank pin 60 is smaller.

Moreover, the upper mold must be replaced by another mold when it is to change the plate bending process or the shape of the product. This is very troublesome in operation. To facilitate such an operation, a shaped mold such as a rounded mold 21 may be placed on the upper mold 54. To accomplish this, the height of the holding ram 52 must greatly be changed. However, this operation is very difficult since the holding ram 62 must be moved up and down with the opening/closing motion of the upper frame portion 52, rather than the independent movement of the holding ram 62 itself. In addition, when any shaped mold is mounted on the upper mold 54, a deviation tends to create in the engagement between the upper and lower molds 54, 53 since the upper mold 54 mounted on the holding ram 62 will be moved up and down along a circular track R about the pivot pin 55. To overcome such a deviation, the mold clamping device must be designed and regulated in an extremely delicate manner.

DISCLOSURE OF THE INVENTION

An object of the present invention is therefore to provide a mold clamping device for a plate bending pressing machine, which is of a simple structure with a low manufacturing cost, is superior in saving the energy, provides an accurate and stable clamping operation and has an improved operability.

To this end, the present invention provides a mold clamping device comprised in a plate bending pressing machine including a main frame having an integral structure, upper and lower molds between which a plate material is inserted and the upper mold being pressed against the lower mold to bend the plate material, comprising:

- a vertically movable holding ram for holding the upper mold;
- at least a pair of left and right arch-type thick springs vertically mounted on an upper half of the main frame;
- a crank mechanism being connected with each of upper portions of the arch-type thick springs through a crank pin and creating a rotational force at a position near a dead center on each of the crank pins,
- wherein the rotational force of the crank mechanism compresses the arch-type thick springs to produce a resilient force which presses the upper mold against the lower mold.

In such an arrangement, the crank mechanism is actuated to lift the holding ram together with the arch-type thick springs for opening the upper mold. When the upper mold is opened, a plate material is inserted into the machine. The crank mechanism is then re-actuated to lower the holding ram together with the arch-type thick springs for closing the upper mold. At this point, the arch-type thick springs are largely compressed near the dead centers of the crank pins. Therefore, the plate material may be clamped against the lower mold under an appropriate resilient force with flexibility but without being stiffened. Furthermore, since the holding ram is moved in the vertical direction, the upper mold may be accurately and stably engaged with the lower mold regardless of the height thereof.

The pressing machine of the present invention may comprise a C-shaped main frame having an opening, upper and lower molds located within the opening, a blade drive located in the lower half of the main frame and a blade for bending the plate material clamped between the upper and lower molds when driven. In such an arrangement, when the blade is to bend the plate material, the upper mold is clamped by the resilient force from the arch-type thick springs. Thus, a little deviation is created in the plate material. This provides stable bending with improved dimensional precision. The holding ram may include a bracket extending therefrom. If a displacement crank mechanism using the pins connecting the arch-type thick springs to the holding ram as crank pins is mounted on the bracket, the upper mold can be mounted and used when the holding ram is lifted by the displacement crank mechanism. The holding ram is slidably and vertically held on guide rails on the main frame through guide blocks.

According to the present invention, the upper portion of the integral main frame structure can include relatively small arch-type thick springs. Thus, the present invention may provide a simple and inexpensive structure with less energy. Since the crank mechanism vertically drives the upper mold holding ram through the arch-type thick springs to compress them, the compressed arch-type thick springs creating the resilient force for clamping the molds, the clamping process can be quickly carried out with accuracy and stability. In addition, the displacement crank mechanism using the pins connecting the arch-type thick springs to the holding ram as crank pins can provide advantages in that the machine can properly accommodate changes and modifications of the mold and improve the operability. In the aforementioned structure of the crank mechanism, the displacement crank mechanism located on the bottom of the arch-type thick springs may be used for clamping the upper mold while the crank mechanism on the top end thereof may be used to displace the upper mold for mounting a shaped mold thereon.

BEST MODES FOR CARRYING OUT THE INVENTION

The present invention will be described in connection with the work of plate material as shown in the accompanying drawings.

Figure 1:
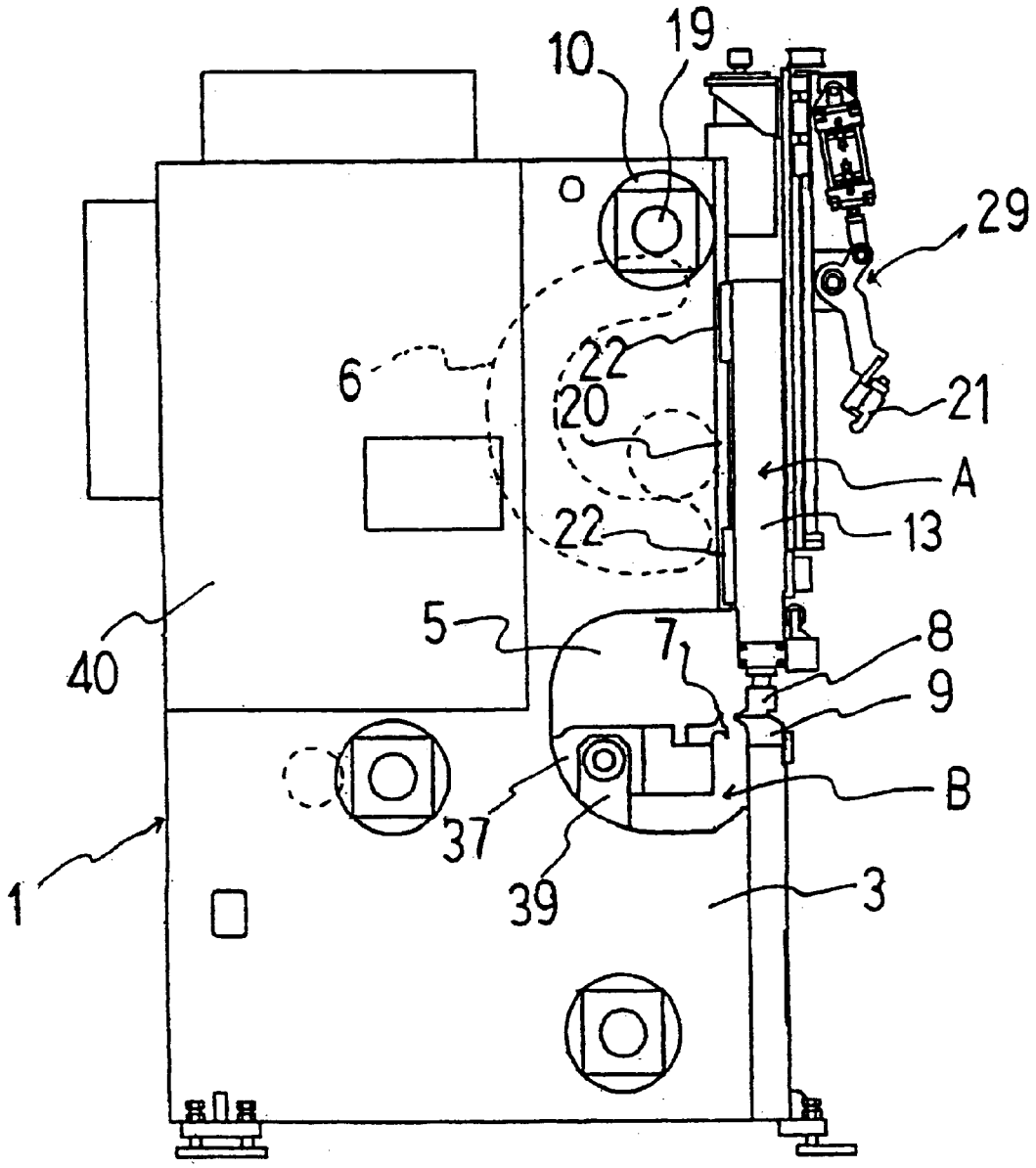
FIG. 1 is a side view of a plate bending pressing machine according one preferred embodiment of the present invention.
Figure 2:
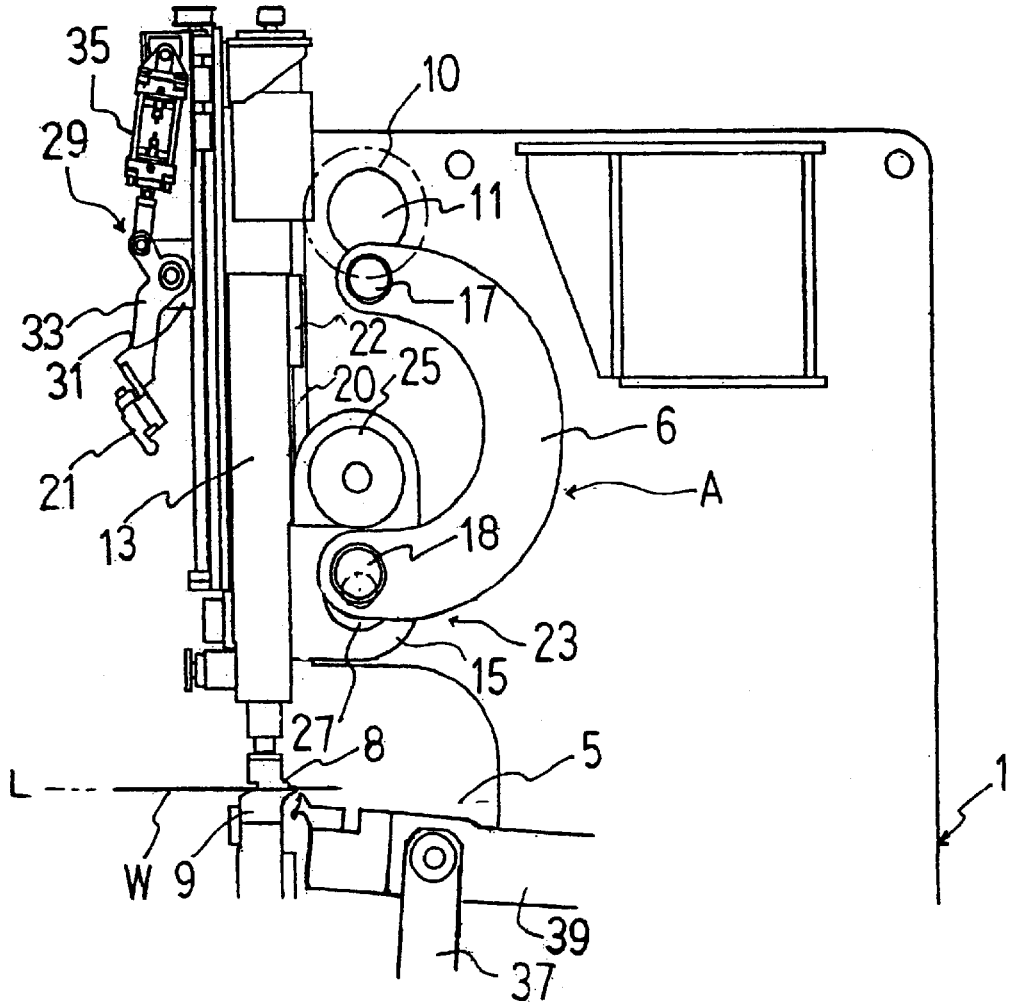
FIG. 2 is an enlarged side view of the main parts in the mold clamping device of the plate bending pressing machine.
Figure 3:
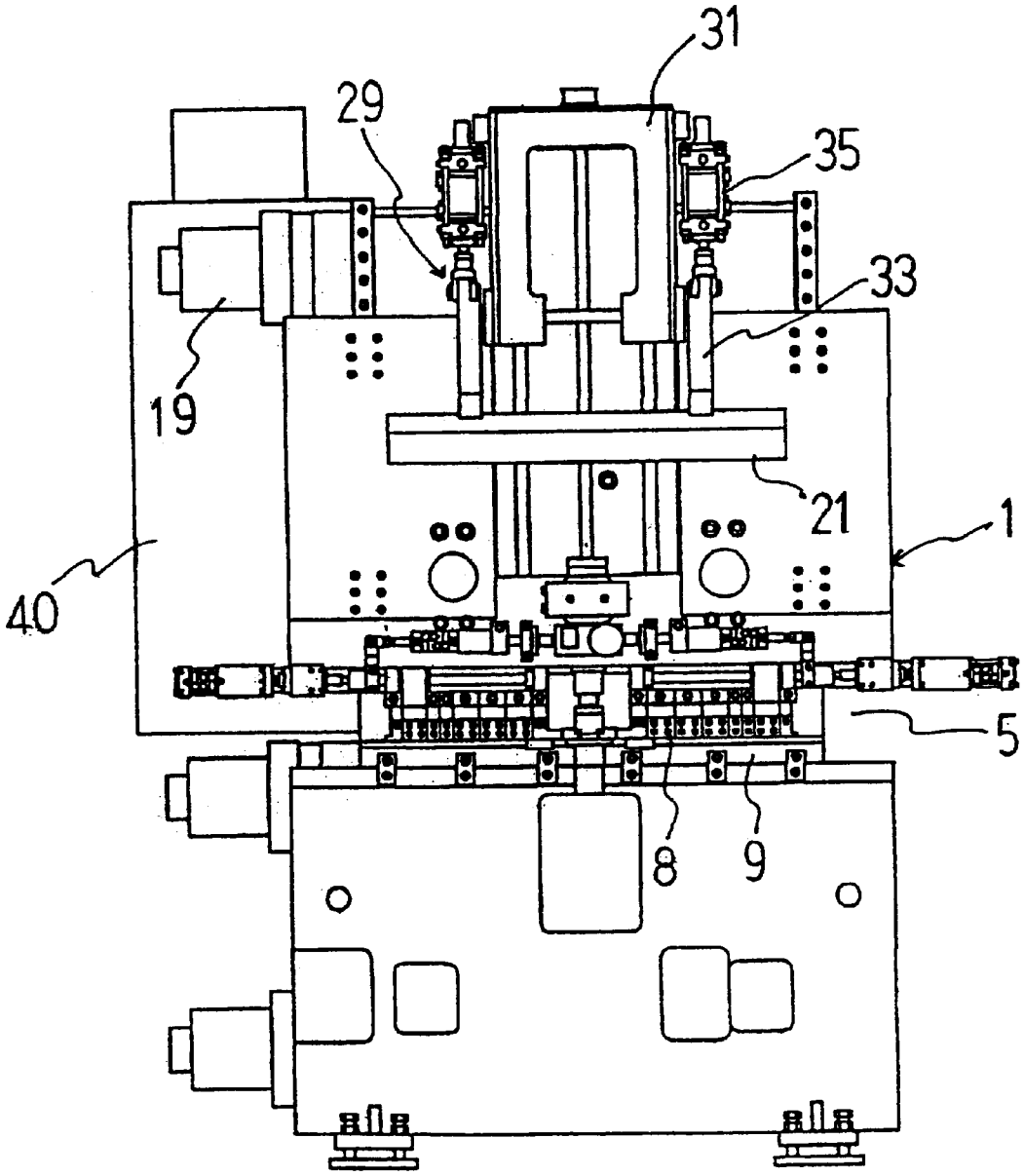
FIG. 3 is a front view of the plate bending pressing machine.
Figure 4:
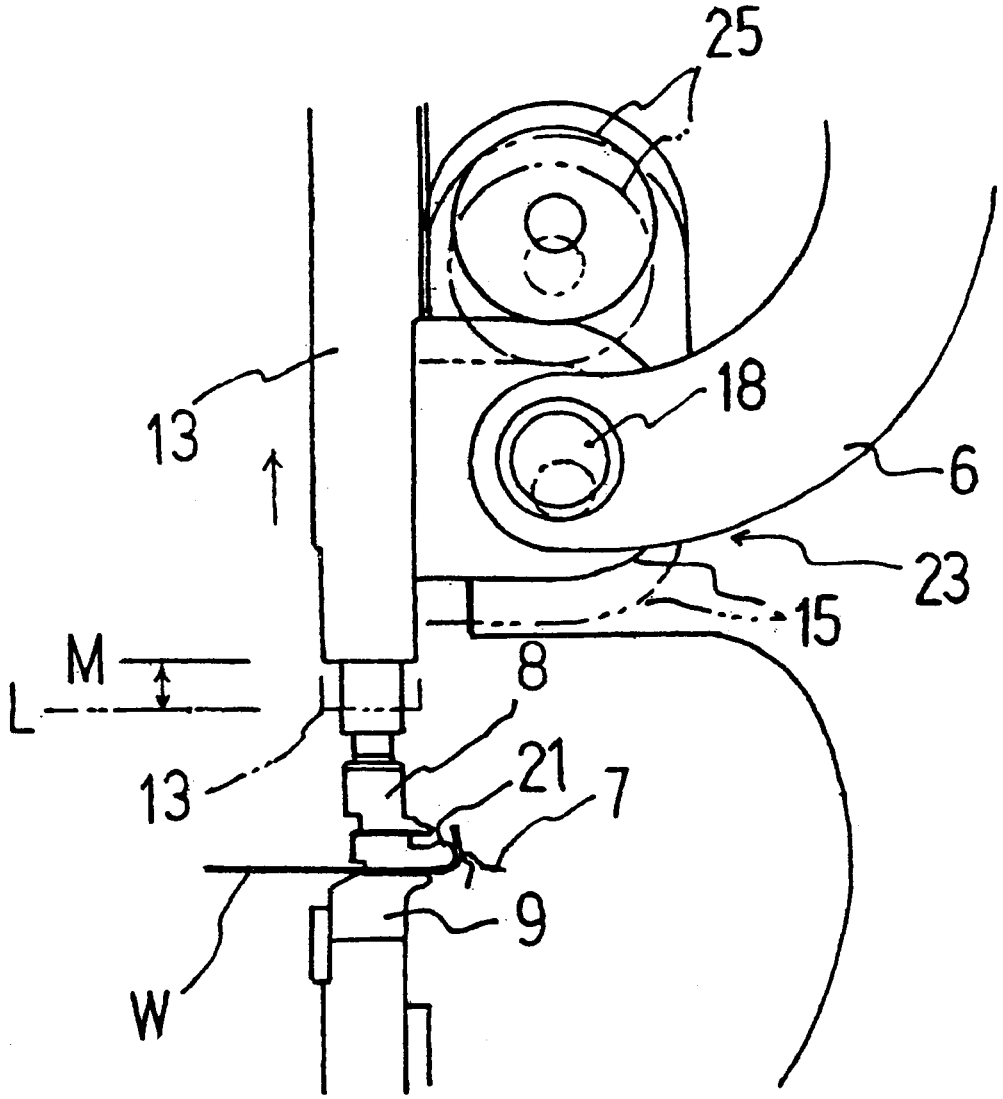
FIG. 4 is an enlarged side view of the primary parts of the pressing machine when a shaped mold is mounted therein.
Figure 5:
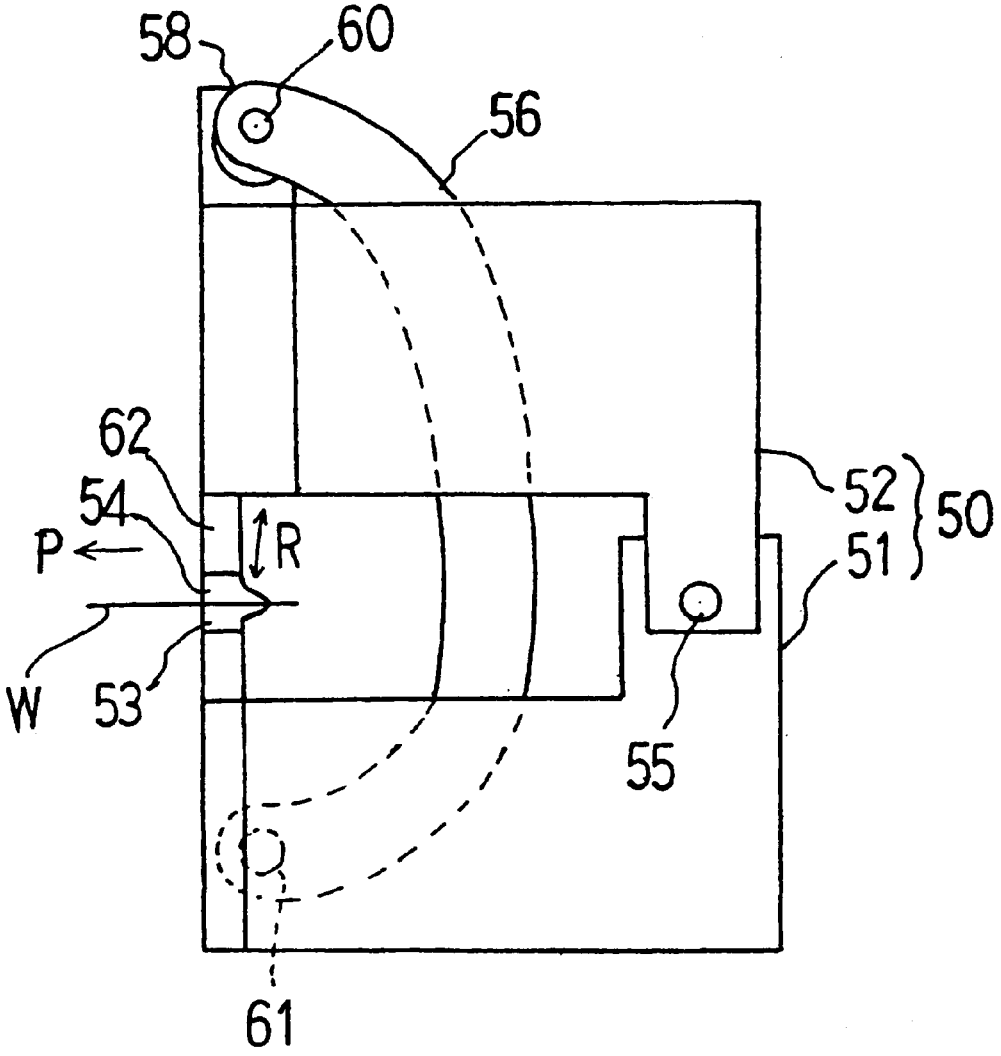
FIG. 5 is a side view of a pressing machine according to the prior art.

Referring to FIG. 1, a plate bending pressing machine comprises a main frame 1 having an integral structure including side plates 3. The main frame 1 also includes an intermediate opening 5 into which a plate material W is to be inserted. The upper half of the main frame 1 above the opening 5 includes a mold clamping device A including a pair of left and right arch-type thick springs 6. The lower half of the main frame 1 below the opening 5 includes a drive B for a blade 7. When an upper mold 8 clamps the plate material W against a lower mold 9 through the mold clamping device A, the plate material W is bent into a predetermined shape by the blade 7. The blade 7 has vertically bifurcated configuration so that the plate material W can be bent easily in both forward and backward directions.

The mold clamping device A includes a crank mechanism 10 which includes a crank shaft 11 rotatably mounted on the upper end of the main frame 1 at an upper position of the opening 5. The mold clamping device A also includes a bracket 15 located below the crank shaft 11 and laterally extending from a holding ram 13 and a pair of left and right arch-type thick springs 6 each of which connects between a crank pin 17 and each of the brackets 15. The lower end of each of the arch-type thick springs 6 is connected with the corresponding bracket 15 through a pin 18. The holding ram 13 is supported for vertical movement, by so-called LM guide rails 20 on the main frame 1 through guide blocks 22 on the holding ram 13.

The trajectory of movement in the crank pins 17 is as shown by one-dot-chain line. A servomotor 19 having a reduction gear rotatably drives the crank pins 17 to move the arch-type thick springs 6 in the vertical direction. Thus, the holding ram 13 is vertically moved to open or close the upper mold 8. When the upper mold 8 is opened, the plate material W is inserted into the opening 5. The crank pins 17 are then rotated in the downward direction to close the upper mold 8. At a position near the bottom dead center, an additional pressure is created to compress the arch-type thick springs 6 so as to produce a resilient, stable and strong force by which the upper mold 8 clamps the plate material W against the lower mold 9.

At this point, it is assumed that the holding ram 13 has height L. In this embodiment, furthermore, a displacement crank mechanism 23 is mounted on each of the brackets 15 and moves the holding ram 13 to an upward position M for mounting a shaped mold 21 on the underside of the upper mold 8. Each of the displacement crank mechanisms 23 includes a servomotor 25 with a reduction gear for driving it. Each of the displacement crank mechanisms 23 also includes a crank shaft 27 rotatably driven by the servomotor 25. The connection pin 18 in each of the arch-type thick springs 6 functions as a crank pin in the corresponding displacement crank mechanism 23. As the crank pins 18 are at or near its top dead center, the shaped mold 21 is used.

Automatic mounting devices 29 are used to mount the shaped mold 21. Each of the automatic mounting device 29 comprises a vertically movable slider 31, an arm 33 for mounting the shaped mold 21 and an air cylinder 35 for driving the arm 33 invertedly. The shaped mold 21 has a rounded working face which cooperates with the blade 7 to bend the plate material W into the desired rounded form. Since the shaped mold 21 is moved in the vertical direction without outwardly deforming the holding ram 13, the shaped mold 21 can uniformly and accurately be pressurized against the lower mold 9 by simply parallel working the top and bottom faces of the shaped mold 21.

The drive B for the blade 7 is in the form of a linkage comprising a drive link 37 extending substantially in X-axis direction and another drive link 39 extending in Y-axis direction and coupled with the drive link 37. Each of the links 37 and 39 is driven by any suitable crank mechanism. Reference numeral 40 denotes an automatic control box.

INDUSTRIAL APPLICABILITY

As described, the mold clamping device in the pressing machine according to the present invention is particularly effective for various bending fields such as forward bending and backward bending. Nevertheless, the mold clamping device can similarly be used to perform highly accurate bending directly using the upper and lower molds as for example when a V-shaped bending is to be carried out by using a lower mold having a V-shaped groove and an upper mold of V-shaped wedge configuration.

What is claimed is:

1. A bending pressing machine, comprising:

a main frame;

a lower mold supported on the main frame;

an upper mold for pressing a plate material inserted between the lower and upper molds;

at least one arch-type thick spring being mounted on an upper half of the main frame and extending in a vertical direction;

a blade driving device mounted on a lower half of the main frame;

a blade driven by the blade driving device to bend the plate material pressed between the lower and upper molds;

a first crank mechanism being connected with an upper portion of the at least one arch-type thick spring through a first crank pin;

a holding ram for supporting the upper mold and being mounted on the main frame for vertical movement;

a second crank mechanism being connected with a lower portion of the at least one arch-type thick spring through a second crank pin; and a bracket extending from the holding ram and connected with the lower portion of the at least one arch-type thick spring through the second crank pin, wherein the upper mold comprises a first upper mold moved up and down by the holding ram and a second upper mold disposed on an underside of the first upper mold, the plate material being inserted between the second upper mold and the lower mold.

2. The bending pressing machine as defined in claim 1, wherein the main frame is configured in a C-shape and includes a front opening into which the plate material is to be inserted and wherein the upper and lower molds are positioned within the opening.

3. The bending pressing machine as defined in claim 1, wherein a pair of the arch-type thick springs are mounted on the upper half of the main frame.

4. The bending pressing machine as defined in claim 1, further comprising:

guide rails on the main frame; and guide blocks being slidably mounted on the guide rails and supporting the holding ram.

5. The bending pressing machine as defined in claim 1, wherein the second upper mold is disposed between the first upper mold and the lower mold when the first crank mechanism moves the lower portion of the at least one arch-type thick spring in an upward direction, and wherein the plate material is clamped between the lower mold and the second upper mold when the second crank mechanism moves the lower portion of the at least one arch-type thick spring in a downward direction at a rotational position of the second crank mechanism near a dead center of the second crank pin.

6. The bending pressing machine as defined in claim 1, wherein the blade comprises blade sections for bending backwards and forwards.

7. The bending pressing machine as defined in claim 1, wherein the second upper mold is disposed between the first upper mold and the lower mold when the second crank mechanism moves the lower portion of the at least one arch-type thick spring in an upward direction, and wherein the plate material is clamped between the lower mold and the second upper mold when the first crank mechanism moves the lower portion of the at least one arch-type thick spring in a downward direction at a rotational position of the first crank mechanism near a dead center of the first crank pin.

* * * * *